United States Patent [19]

Sakai et al.

[11] Patent Number: 4,691,415

[45] Date of Patent: Sep. 8, 1987

[54] ROLLER OF DRAFT APPARATUS

[75] Inventors: Shoji Sakai, Nagaokakyo; Koshi Noda, Joyo, both of Japan

[73] Assignee: Murata Kikai Kabushiki Kaisha, Kyoto, Japan

[21] Appl. No.: 893,007

[22] Filed: Aug. 4, 1986

[30] Foreign Application Priority Data

Aug. 12, 1985 [JP] Japan ..... 60-123837

[51] Int. Cl.[4] ..... D01H 5/74

[52] U.S. Cl. ..... 19/262; 28/295

[58] Field of Search ..... 19/258, 262, 264, 265; 28/295

[56] References Cited

U.S. PATENT DOCUMENTS

| | | | |
|---|---|---|---|
| 132,714 | 11/1872 | Dunham | 19/262 X |
| 158,698 | 1/1875 | Gambrill et al. | 19/265 X |
| 710,539 | 10/1902 | Thomson | 19/262 X |
| 1,582,656 | 4/1926 | Andrews | 19/265 X |
| 2,260,130 | 10/1941 | Armstrong et al. | 19/258 X |
| 2,736,962 | 3/1956 | Putmon | 28/295 X |
| 2,800,686 | 7/1957 | Long et al. | 19/265 X |

*Primary Examiner*—Louis K. Rimrodt

*Attorney, Agent, or Firm*—Barnes, Kisselle,, Raisch, Choate, Whittemore & Hulbert

[57] ABSTRACT

A draft roller in a spinning machine in which its portion in contact with a fiber bundle, i.e. the draft portion, is made relatively large in diameter, and the roller portion adjacent to the draft portion are tapered gradually away from the draft portion so that fibers wound around the draft portion are moved therefrom to the tapered portions and can be removed easily.

2 Claims, 2 Drawing Figures

ROLLER OF DRAFT APPARATUS

FIELD OF THE INVENTION AND RELATED ART STATEMENT

The present invention relates to a roller of a draft apparatus in a spinning machine.

A draft apparatus is provided with plural pairs of draft rollers such as back rollers, middle rollers and front rollers. The roller pairs rotate while holding a fiber bundle under pressure to thereby draft the fiber bundle at a predetermined draft ratio. These roller pairs are each composed of a bottom roller which is rotated positively by a motor and a top roller which is brought into pressure contact with the bottom roller and thereby rotated. Generally, the bottom rollers are constituted as a single shaft common to all spindles, while the top rollers are constituted as relatively short shafts which are independent at every two spindles. In order to ensure the gripping for a fiber bundle between bottom and top rollers, usually the bottom roller portion in contact with the fiber bundle is formed with a fine unevenness, while a rubber cot is fitted over the outer periphery of the top roller portion. More specifically, the portion (hereinafter referred to as the "draft portion") of the bottom roller which is contact with a fiber bundle is merely formed so that its outside diameter is the same as or slightly larger than that of the other portion. Where a plurality of shafts are interconnected to constitute a single bottom roller, the connections are sometimes made smaller in diameter than the draft portion. Even in such a case, however, the roller portions adjacent to the draft portion have about the same outside diameter as that of the draft portion, and in many cases there is formed a stepped portion at the boundary of the large and the small diameter portion of the bottom roller.

During operation of a draft apparatus, short fibers which constitute the above fiber bundle are sometimes separated from the fiber bundle and wind around the draft roller. Once this occurs, there arises unevenness in thickness or breakage of spun yarn, so in this case it is necessary to discontinue the spinning operation and remove the fibers wound onto the roller. If the fibers on the roller are cut with a cutter knife or the like, the peripheral surface of the roller may also be damaged by the knife, so the use of such knife or the like is not desirable. Since the top rollers are independent at every two spindles as previously noted, the fibers wound onto the top rollers are easily removed by being moved axially of the rollers, while the bottom rollers are constituted as a single shaft common to all spindles and the entirety is about the same in diameter, so the removal of the wound fibers is an extremely difficult work.

OBJECT AND SUMMARY OF THE INVENTION

It is an object of the present invention to provide a roller of a draft apparatus from which fibers wound onto the roller can be easily removed.

The draft roller of the present invention is characterized in that its portion in contact with a fiber bundle, i.e. the draft portion, is made relatively large in diameter, and the roller portions adjacent to the draft portion are tapered gradually away from the draft portion.

According to the draft roller of the present invention, when fibers are wound around the draft portion, the fibers are moved from the draft portion to the above tapered portions whereby looseness can be imparted to the fibers. If in this state a suitable cutter is inserted between the fibers and each tapered portion to cut the fibers, the wound fibers can be removed easily without damaging the peripheral surface of the roller.

DETAILED DESCRIPTION OF PREFERRED EMBODIMENTS

Figure 2:
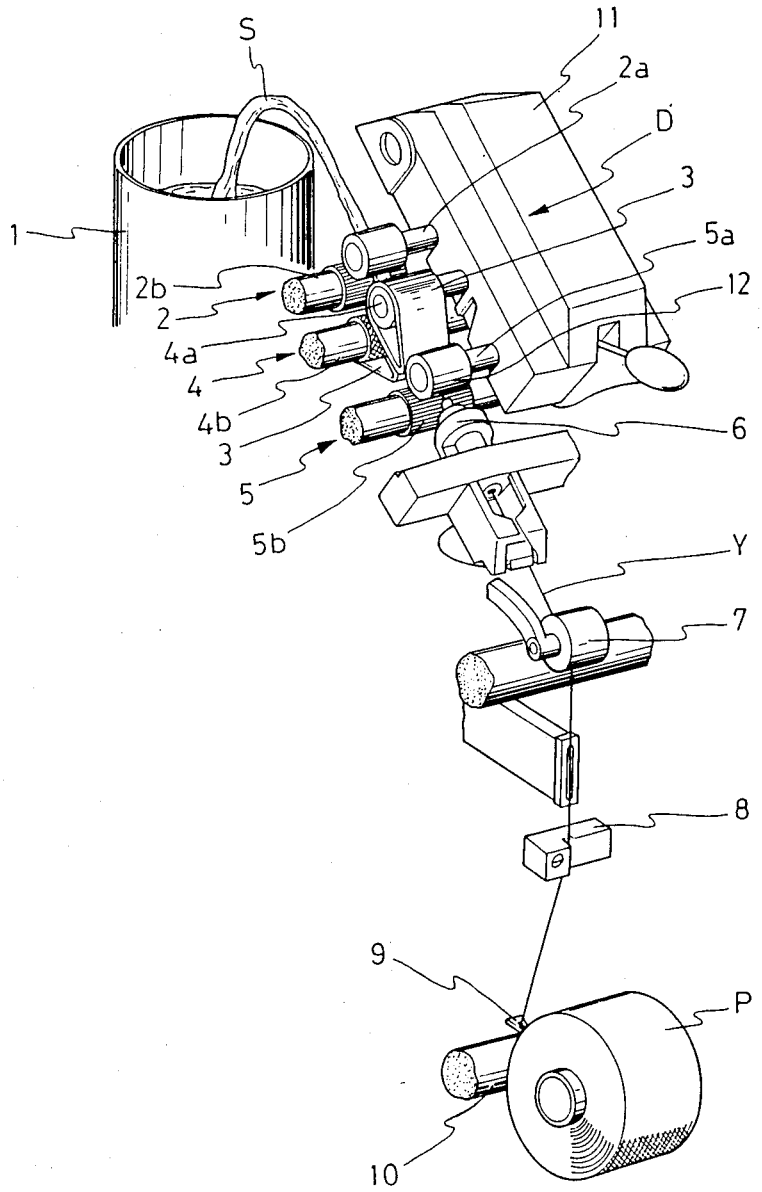
FIG. 2 is a perspective view of a pneumatic type spinning machine.

FIG. 2 illustrates a pneumatic type spinning machine, in which a fiber bundle or sliver S drawn out from a can 1 passes through a draft apparatus D which comprises back rollers 2, middle rollers 4 each having an apron 3 and front rollers 5. Thereafter, the sliver S is introduced into an air injection nozzle 6, then drawn out by delivery rollers 7 and passes through a slub catcher 8. Further, it is guided by a traverse guide 9 and wound onto a package P being rotated by means of a friction roller 10. The above draft rollers, namely, back rollers 2, middle rollers 4 and front rollers 5, are respectively constituted as pairs of top rollers 2*a*, 4*a*, 5*a* located above and bottom rollers 2*b*, 4*b*, 5*b* located below. The top and bottom rollers rotate while holding the sliver S under pressure to draft the sliver. The top rollers are independent at every two spindles and they are supported by a top roller support 11. The bottom rollers are constituted as a single shaft common to all spindles, which shaft is rotated positively by means of a motor (not shown). Actually, this shaft comprises rollers independent at every two spindles and interconnected in series by coupling. Further, a cylindrical rubber cot 12 having a uniform thickness is fitted over the top roller portion which is in contact with the sliver S. The sliver S can be gripped positively by the elasticity of the said rubber. The air injection nozzle 6 applies a compressed air stream to the sliver S leaving the front rollers 5 to thereby twist the sliver to obtain a spun yarn Y.

Figure 1:
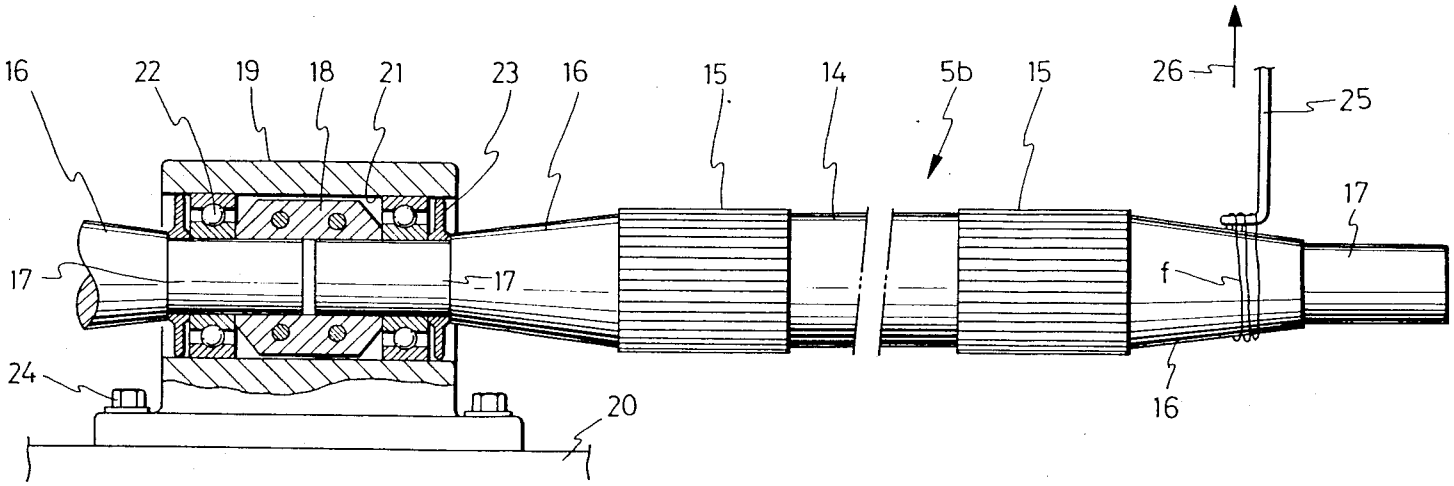
FIG. 1 is a view showing a draft roller embodying the present invention.

FIG. 1 illustrates the front bottom roller 5*b* and a structure for supporting the same.

The bottom rollers 5*b*, formed of a metal, are independent at every two spindles as previously noted and are interconnected by a later-described coupling. Each roller 5*b* comprises draft portions 15 formed on both sides of a central portion 14 having a uniform thickness, tapered portions 16 formed outside the draft portions, and connections 17 of a small diameter formed at still outside end portions. The draft portions 15 which are in pressure contact with the top roller 5*a* through the fiber bundle S have a diameter slightly larger than that of the central portion 14, and the connections 17 are of the smallest diameter. The tapered portions 16 are each in a conical shape which connects the outer periphery of the draft portion 15 and that of the connection 17 smoothly to prevent the formation of a clear difference in height between both portions. That is, the outside diameter of the tapered portion decreases gradually from the draft portion 15 toward the connection 17. The front roller 5*b* is provided in plural numbers, which are interconnected and fixed by means of a coupling 18 in an opposed state of the connections 17. Numeral 19 denotes a bottom roller supporting block fixed onto a base 20 of the spinning machine. The coupling 18 is housed in an axial bore 21 of the supporting block 19, and bearings 22 are provided between the connections 17 on both sides of the coupling 18 and the supporting block 19, whereby the bottom roller **5*b* is supported rotatably. Numeral 23 denotes a collar for preventing the entry of dust, etc. and numeral 24 denotes a bolt for fixing the supporting block 19. In FIG. 1, the coupling 18, etc. at the right end portion of the roller 5*b*** are omitted.

The following description is now provided about the operation of the roller **5*b***.

During draft operation, when fibers wind around the right-hand draft portion 15 in FIG. 1, the operator moves the wound fibers toward the right-hand tapered portion 16 by means of a suitable jig. Since the tapered portion 16 is of a smaller diameter than the draft portion 15, the wound fibers f thus moved are loosened on the tapered portion 16. Then, a suitable cutter or jig 25 is inserted between the wound fibers f and the tapered portion 16 and pulled in the direction of arrow 26 to thereby cut and remove the fibers f.

Since the tapered portion 16 is of a smaller diameter than the draft portion 15, the foregoing wound fiber removing operation is facilitated. On the other hand, where the tapered portion 16 is not conical but cylindrical, that is, where the tapered portion 16 is in the form of a cylinder having approximately the same diameter as the connection 17, there is formed a large difference in height at the boundary of the tapered portion 16 and the draft portion 15 and consequently there arises the following problem. Such a roller is subjected to a quench hardening treatment in the manufacturing process for impartment of strength thereto. But since there is the above difference in height on the roller, the quench hardening becomes non-uniform at this stepped portion, thus resulting in formation of a weak point in strength. Such a difficulty in quench hardening treatment can be overcome by forming the tapered portion 16 conically to remove the above difference in height, whereby a roller having a sufficient strength can be obtained.

Although in FIG. 1 the tapered portions 16 are formed outside the draft portions 15, they may be formed in inside positions, namely, at the central portion 14. However, most preferred dynamically is the roller shape shown in FIG. 1 in which the connections 17 at both ends supported by the bearings 22 are made small in diameter, and from the connections 17 there are formed the large diameter draft portions 15 and central portion 14 through the conical tapered portions 16.

According to the roller of the present invention, the fibers wound around the draft portions can be removed easily and it is possible to maintain a sufficient strength.

What is claimed is:

1. A draft apparatus for drafting a fiber bundle while holding the fiber bundle under pressure by plural pairs of rotating rollers which comprises:

(a) a plurality of draft rollers each having a support end and spaced, coaxial, cylindrical serrated draft sections separated by a cylindrical portion of slightly smaller uniform diameter in comparison to the diameter of the serrated sections, and tapered sections connecting the serrated sections and said support ends in a gradually reducing tapered angle, and (b) a cutter element positionable adjacent the smaller end of said tapered sections movable in a direction transverse to the axis of rotation of said rollers to cut and release the loops of fibers moving from said draft sections and collecting on said tapered section.

2. A draft apparatus as defined in claim 1 in which said cutter element comprises a portion parallel to said axis of rotation of said rollers and movable from a position adjacent a tapered section of said rollers to a position spaced from said axis to cut and remove said fibers.

* * * * *